United States Patent [19]

Idema

[11] Patent Number: 4,809,431

[45] Date of Patent: Mar. 7, 1989

[54] NAIL CLIPPING DEVICE

[76] Inventor: Stanley D. Idema, 1657 Hiawatha Rd., SE., Grand Rapids, Mich. 49506

[21] Appl. No.: 116,460

[22] Filed: Nov. 3, 1987

[51] Int. Cl.[4] ..... A45D 29/02

[52] U.S. Cl. ..... 30/28; 30/124; 132/73.5

[58] Field of Search ..... 30/27, 28, 124, 125; 132/73, 73.5, 76.2, 76.5

[56] References Cited

U.S. PATENT DOCUMENTS

| | | |
|---|---|---|
| 1,841,847 | 1/1932 | Peters . |
| 1,942,565 | 1/1934 | Murphy . |
| 2,179,435 | 11/1939 | Smith . |
| 2,632,947 | 3/1953 | Hunt et al. . |
| 2,837,821 | 6/1958 | David . |
| 3,180,025 | 4/1965 | Tsunemi . |
| 3,389,462 | 6/1968 | Bowers . |
| 3,744,131 | 7/1973 | Manes . |
| 4,062,109 | 12/1977 | Min . |
| 4,150,481 | 4/1979 | Min . |
| 4,196,514 | 4/1980 | Merriman . |
| 4,550,496 | 11/1985 | Reinicke . |
| 4,640,011 | 2/1987 | Gamble . |
| 4,648,415 | 3/1987 | Yuan . |

FOREIGN PATENT DOCUMENTS

| | | | |
|---|---|---|---|
| 1201884 | 3/1986 | Canada | 30/28 |

*Primary Examiner*—Frank T. Yost

*Assistant Examiner*—Michael D. Folkerts

*Attorney, Agent, or Firm*—Varnum, Riddering, Schmidt & Howlett

[57] ABSTRACT

A device for clipping fingernails, toenails and the like comprises lower and upper spring members carrying lower and upper cutting means. A reaction pin is rotatable on the spring members. A thumb bar is nonrotatably mounted to the pin about a first axis coinciding with an axis of the reaction pin to an from an operative position and is rotatable about a second axis normal to the first axis to urge the cutting means together in nail clipping engagement in the operative position. A receptacle for accumulating nail clippings is carried by the lower member and has an outlet. A plate mounted to the pin closes the outlet in the operative position of the thumb bar and automatically moves from its closed position upon rotation of the bar from its operative position to permit emptying of the receptacle of nail clippings. In another embodiment, the upper and lower members are hingeably mounted together at respective ends and movable between open and closed positions, and the device further comprises a latch carried by the reaction pin. The latch engages the lower element in the operative position of the bar to set the members in the closed position and automatically moves out of engagement with the lower element upon rotation of the bar away from its operative position to dispose the members in the open position to permit the receptacle to the emptied of clippings.

40 Claims, 4 Drawing Sheets

NAIL CLIPPING DEVICE

FIELD OF THE INVENTION

The invention relates to nail clippers and more particularly to a device for clipping fingernails, toenails and the like, and having formed thereon a receptacle for retaining nail clippings.

BACKGROUND OF THE INVENTION

Known are nail clipping devices useful for manicuring or pedicuring purposes. Such devices typically comprise a pair of resilient metal leaf springs secured together in overlapping engagement at respective first ends of the springs and having at respective second ends thereof blades or shearing elements movable upon actuation of a handle to a position where the blades are set in nail clamping engagement. A fingernail or toenail positioned between the blades can be severed upon actuation of the handle.

A disadvantage of conventional nail clipping devices is that they permit the scattering of nail clippings, such scattering caused by the manner in which the blades or shearing elements operate. Specifically, the blades, when moved to the clamping position, compress the nail, thus flattening its natural curvature. When the nail is clipped, the same snaps back to its natural shape thereby projecting the clipping into unpredictable trajectories. Such clippings, for example, can lodge in a user's eye resulting in grave consequences. More often, however, the clippings find their way into the pile of a carpet. There, the clippings tend to accumulate and can result in injury to an unprotected foot of a person walking on the carpet.

To solve the foregoing disadvantage associated with conventional nail clipping devices, there has been provided on such devices receptacles and the like in which the clippings are prevented from scattering and collected for disposal. Such improved nail clipping devices are typified by receptacles or the like extending along the lower and/or upper leaf springs. See, for example, U.S. Pat. Nos. 3,180,025, to Tsunemi, issued Apr. 27, 1965; David, 2,837,821, issued June 10, 1958; and Smith, 2,179,435, issued Nov. 7, 1939.

While such improved clipping devices prevent the scattering of clippings, they are objectionable in that use of such clipping devices result in the accumulation of clippings in the receptacle due to (1) the shape of the receptacle, (2) the inconvenient position of the opening thereon permitting removal of the clippings and (3) the fact that emptying the receptacle requires an additional step over and above the step of setting the clipping device handle from an operative position to a stored position, which step is often not performed as being inconvenient. The accumulation of clippings in the receptacle render it difficult to clip nails when the retainers are filled and is unsanitary.

It has thus been found desirable to provide a nail clipping device having a receptacle for trapping nail clippings, wherein the nail clippings can be easily emptied from the receptacle at the same time and by the same action of moving the handle from its operative to its inoperative stored position. It has been further desirable to provide such a nail clipping device with other advantages hereinafter discussed in detail.

SUMMARY

A nail clipping device comprises a pair of lower and upper spring members joined at respective first ends thereof and resiliently diverging at respective second ends of the members. Opposed cutting means are on the lower and upper spring member second ends. A reaction pin is rotatably carried by the second ends and has a shoulder means abutting the lower spring member and a notch positioned above the upper spring member. A thumb bar has an end received in the notch to secure the thumb bar to the reaction pin. The thumb bar is rotatable with the reaction pin about a first axis coinciding with the longitudinal axis of the reaction pin to an operative position, rotatable relative to the reaction pin about a second axis normal to the first axis and has a fulcrum positioned to engage the upper spring member when the thumb bar is rotated about the second axis in the operative position to urge the cutting means together in nail clipping engagement. The lower spring member further includes a receptacle means positioned to receive nail clippings and having an outlet. A closure means is positioned to close the outlet in the operative position of the thumb bar and adapted to be automatically moved from the closed position to permit clippings to be removed from the receptacle means through the outlet when the thumb bar is moved from the operative position about the first axis.

The closure means comprises a plate secured to the reaction pin and adapted to be moved to and from the closed position when the thumb bar is moved to and from the operative position about the first axis. The plate is cooperable with the receptacle means over the outlet to retain clippings within the receptacle means in the operative position of the thumb bar.

The device further includes an indexing means for preventing inadvertent rotational movement of the thumb bar with respect to the lower and upper spring members in the operative position of the thumb bar. The indexing means comprises at least one flange on the reaction pin and at least one notch on the lower spring member, the flange adapted to be received in the notch in the operative position of the thumb bar.

In an alternative embodiment of the invention, the receptacle means comprises a bottom wall having an opening extending therethrough, and the reaction pin is positioned in rotatable registry with the opening and within the receptacle means. In addition, in the alternative embodiment, the closure plate is mounted to the pin below the receptacle means bottom wall and defines the shoulder means in constant engagement with the bottom wall when the plate is moved to and from the closed position.

A further embodiment of the device comprises a pair of lower and upper elements positioned in overlapping relationship, having respective first and second ends, hingeably mounted together at respective second ends and movable between an open position spaced relatively far apart, a preclosed position spaced relatively close together and a closed position. A pair of lower and upper cutting means are on the lower and upper element respective second ends and are adapted to cooperate to clip a nail interposed between the lower and upper cutting means in the closed position of the elements. A reaction pin is rotatably carried by the upper element second end and has a notch positioned above the upper element. A biasing means is positioned between the lower and upper elements and biases the elements from the closed position. A thumb bar has an end received in the notch to mount the thumb bar to the reaction pin. The thumb bar is rotatable with reaction pin about a first axis coinciding with a longitudinal axis of the reaction pin between an operative position and a second position. The thumb bar is rotatable relative to the reaction pin about a second axis normal to the first axis and has a fulcrum positioned to engage the upper element when the thumb bar is rotated about the second axis in the operative position to urge the lower and upper elements to the closed position against the biasing means to set the lower and upper cutting means in nail clipping engagement. A latch means is positioned to engage the lower element in the operative position of the thumb bar to set the lower and upper elements in the preclosed position and positioned out of engagement with the lower element in the second position of the thumb bar to position the lower and upper elements in the open position. A recepacle means on the lower element is adapted to receive nail clippings and is adapted to be emptied of the clippings in the open position of the lower and upper elements.

The device further comprises a retainer means on the lower element. The latch means is mounted to the reaction pin and adapted to be moved to and from engagement with the retainer means to set the lower and upper elements to the preclosed and open positions when the thumb bar is moved to the operative and second positions, respectively.

The device also includes an indexing means on the retainer means and for restricting movement of the latch means and preventing inadvertent rotational movement of the thumb bar with respect to the lower and upper elements in the operative position of the thumb bar.

The thumb bar is also rotatable about the first axis to a third position removed from the first position, is rotatable about the second axis from the third position to a stored position in overlapping relationship to the lower and upper elements and further comprises a means engaging the upper element and for urging the lower and upper elements to the closed position in the stored position of the thumb bar. The urging means is formed by a bent portion of the end of the thumb bar.

BRIEF DESCRIPTION OF THE DRAWINGS

Reference will now be made to the drawings in which.

DESCRIPTION OF THE PREFERRED EMBODIMENTS

Referring now to FIGS. 1–5, there is shown a nail clipping device having a receptacle for preventing the scattering of nail clippings and accumulating the same for subsequent convenient disposal.

Figure 1:
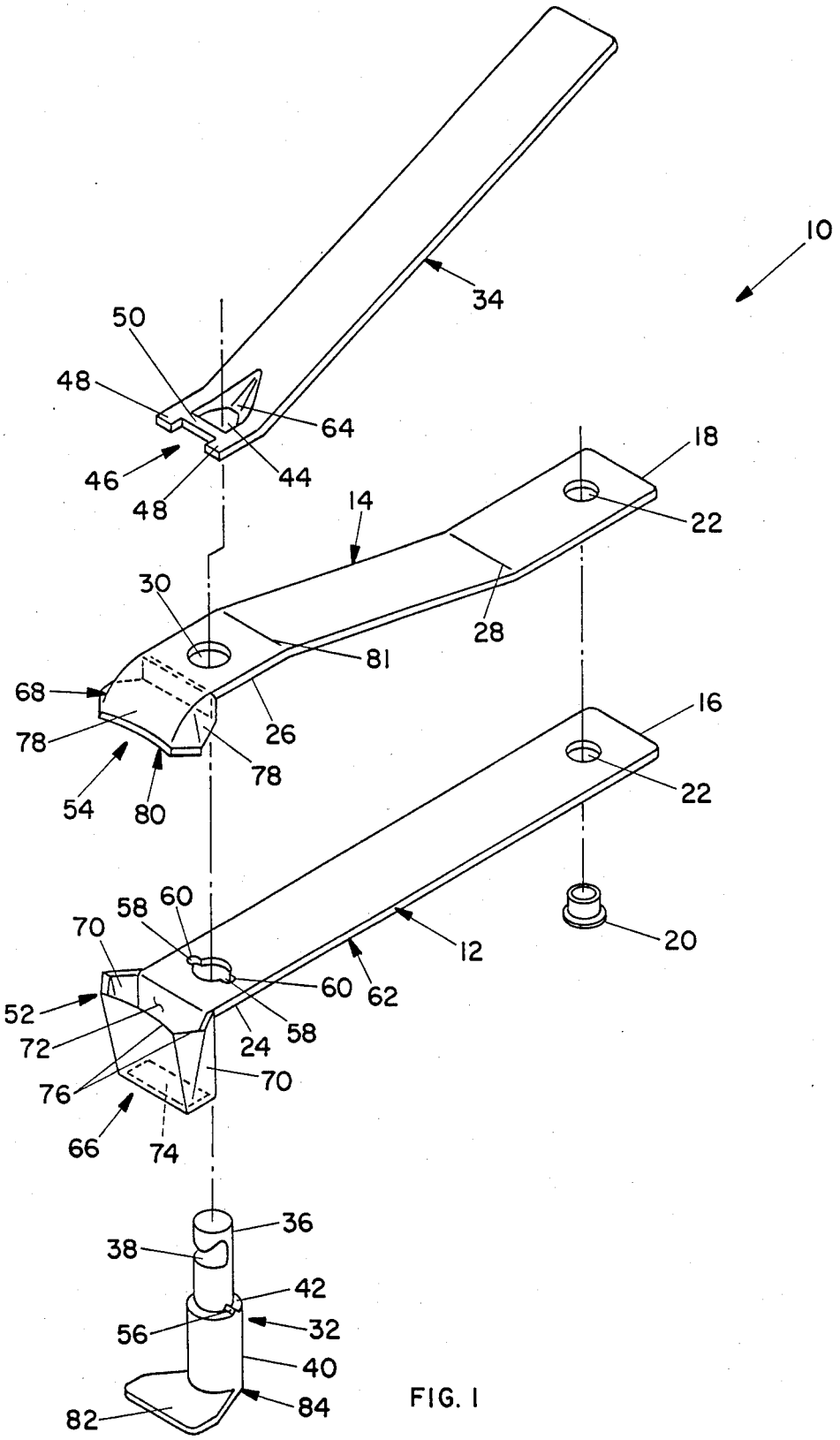
FIG. 1 is an exploded perspective view of a nail clipping device according to the invention.
Figure 2:
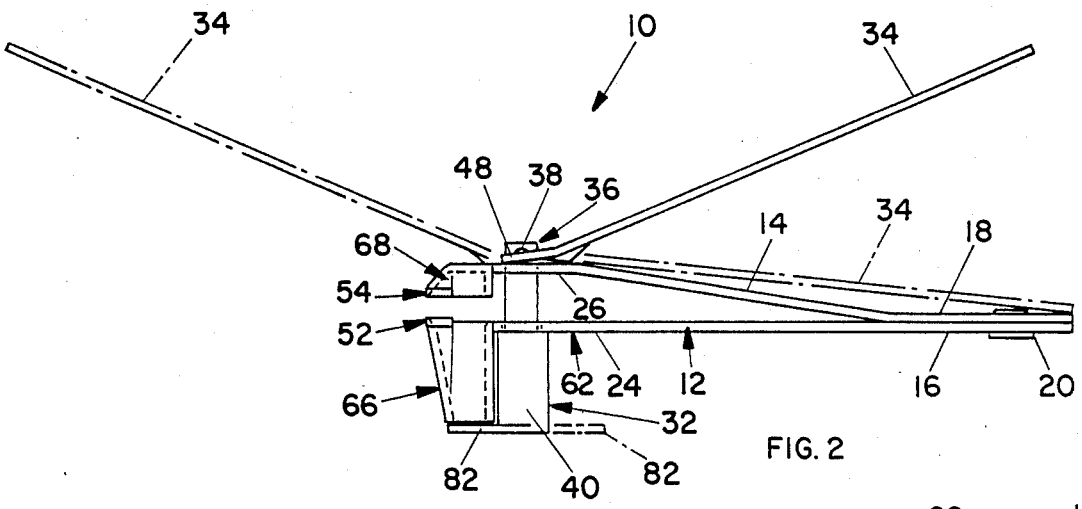
FIG. 2 is a side elevational view of the device showing a thumb bar thereof in operative, prestored and stored positions.
Figure 3:
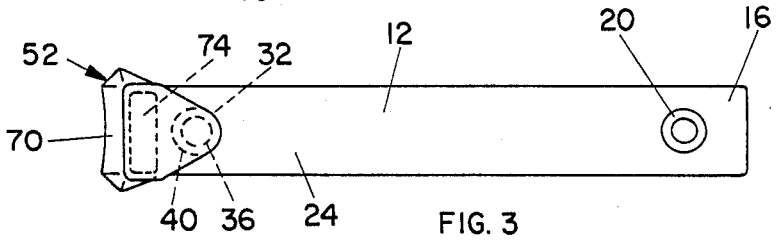
FIG. 3 is a bottom view of the device.

In one embodiment of the device 10, illustrated in FIGS. 1–3, the same comprises a lower substantially flat spring member 12 and an upper spring member 14, the upper and lower spring members securely mounted together in overlapping engagement at first ends 16, 18, respectively, thereof by a rivet 20 extending through aligned openings 22 in the spring members. It is contemplated, however, that the members 12, 14 can be secured together at respective first ends 16, 18 by any suitable mechanical means, such as by welding. The spring members 12, 14, diverge toward second ends 24, 26, respectively, thereof due to the upper spring member being bent upwardly at 28. The second ends 24, 26 of the spring members are provided with aligned holes 30, the functions of which will be discussed below. The spring members are preferably made of stainless or plated steel.

The rivet 20 can form a mounting for a nail file (not shown) extending along either the lower member 12 or the upper member 14, and for use in filing nails after a clipping operation. The rivet 20 pivotally mounts the nail file about the axis of the rivet to extend to one side of the device 10 or along the lower or upper spring member in a manner known in the art and not herein described further.

The upper and lower spring members 12, 14 are biased toward each other at respective second ends 24, 26 by a reaction pin 32 and a thumb bar 34. The reaction pin 32 is substantially cylindrical in shape and has an upper portion 36 with a downwardly-facing notch 38, and a lower stepped portion 40, the upper edge of which defines a shoulder 42. The thumb bar 34 has a notch 44 formed in a transverse end 46 of the bar, thereby forming bifurcated end portions 48 between which spans a crossbar 50. The thumb bar notch 44 is aligned with the aligned holes 30 in the lower and upper spring members 12, 14. The spring members are rotatably mounted to the reaction pin 32, with the upper portion 36 of the same in registry with the aligned holes 30 of the spring members and the shoulder 42 of the pin rotatably engaging the lower spring member 12. The thumb bar 34 is positioned above the upper spring member, is securely mounted to the reaction pin 32 for non-rotatable movement with respect thereto about a first axis coinciding with the longitudinal axis of the reaction pin, with the bifurcated portions 48 straddling the pin upper portion 36 and the crossbar 50 securely engaging the pin 32 within the notch 44 thereof. In this position of the thumb bar 34, the same biases the upper and lower spring members 12, 14 toward each other against the natural diverging tendency of the same. In this manner, the upper spring member 14 exerts an upward force on the thumb bar 34 thereby urging the crossbar 50 in secure engagement with the reaction pin 32 within the notch 44 thereby maintaining a secure mounting of the lower and upper spring members 12, 14 and the thumb bar 34 with respect to the reaction pin 32. The lower and upper spring members 12, 14 are provided with upper and lower cutting means 52, 54 on respective second ends 24, 26 of the members.

The thumb bar 34 is rotatable 360° with the reaction pin about the first axis with respect to the lower and upper spring members 12, 14 between an operative position, shown in FIGS. 1 and 2 in solid lines and a prestored position illustrated in FIG. 2 in phantom lines. The thumb bar 34 is also rotatable with respect to the reaction pin about a second axis defined substantially by the cross bar 50 and normal to the first axis to a stored position in overlapping engagement with the upper spring member 14, also shown in FIG. 2 in phantom lines. The thumb bar 34 can be moved from the operative position to the stored position, by turning the same with the reaction pin 32 180° about the first axis to the prestored position of the thumb bar and subsequently rotating the thumb bar about the second axis defined by the crossbar 50 in overlapping engagement with the upper spring member 14.

To prevent inadvertent rotational movement of the thumb bar 34 about the first axis with respect to the lower and upper spring members 12, 14 in the operative and stored positions of the thumb bar, the device 10 is provided with an indexing means comprising a pair of wedged flanges 56 formed on the shoulder 42 of the reaction pin 32 and a pair of slots 58 formed by extensions of the hole 30 in the lower spring member 12. The wedged flanges 56 are adapted to register with the slots 58 in the operative and stored positions of the thumb bar 34. Interference of the flanges 56 with edges 60 of the slots 58 prevent inadvertent movement of the thumb bar 34 in its operative and stored positions about the first axis. However, when it is desired to turn the thumb bar 34 and the reaction pin 32 secured thereto between stored and operative positions, sufficient rotational force applied to the thumb bar will cause the wedged flanges 56 to ride over the edges 60 of the slots 58 to thereafter permit rotation of the thumb bar to the desired position with relatively little interference other than frictional resistance of the bottom surface 62 of the lower spring member 12 with movement of the wedges over the bottom surface.

As indicated above, the second ends 24, 26 of the springs members 12, 14 are normally set in spaced-apart relationship in an open position due to the bend at 28 in the upper spring members. The second ends 24, 26 are flexed to move to a clipping position with the lower and upper cutting means 52, 54 in tight engagement operation of the thumb bar 34 in the operative position. To this end, the thumb bar 34 is provided with a heel 64 adjacent the notch 44, engaging the upper spring member 14 in the operative position of the thumb bar, and reactive against the downwardly-facing notch 38 of the reaction pin 32 upon downward rotation of the thumb bar about the second axis with respect to the spring members, to move the same together to effect clipping of a nail positioned between the lower and upper cutting means 52, 54.

To retain nail clippings for subsequent disposal, the device 10 is provided with a receptacle means comprising a receptacle 66 forming a box-like extension of the second end 24 of the lower spring member 12. The receptacle is preferably constructed of stainless or plated steel. An upper cover 68 forms an extension of the second end 26 of the upper spring member 14 and functions to prevent the scattering of clippings as discussed below. The cover is preferably constructed of stainless or plated steel.

Although the receptacle 66 is shown as being generally hexagonal in shape, it is contemplated that the receptacle can be of various polygonal configurations. The receptacle 66 has sidewalls 70, an open top 72 and an open bottom 74. Free edges 76 of the sidewalls 70 are sharpened to form the lower cutting means 52 referred to above. The upper cover 68 has walls 78, free ends 80 of which are also sharpened to form the upper cutting means 54. The upper cover 68 is of substantially the same polygonal configuration as the receptacle 66 so that when the second ends 24, 26 of the spring members 12, 14 are moved to the cutting position, the edges 76 and ends 80 and the lower and upper cutting means 52, 54 formed thereon are set in substantially full registry to effect cutting of a nail upon actuation of the thumb bar 34. To ensure substantially full registry of the lower and upper cutting means 52, 54, the second end 26 of the upper spring member 14 is set in a plane substantially parallel with the orientation of the lower spring member 12 by virtue of a bend at 81 on the upper spring member.

As shown most clearly in FIG. 1, the lower and upper cutting means 52, 54 are provided on all free edges and ends, 76, 80 the receptacle 66 and the upper cover 68. This design provides an advantage over prior-art leaf spring-type conventional nail clippers which have pairs of overlapping substantially linear cutting blades, a design which inevitably requires numerous cutting steps to remove a single nail portion from a nail. According to the invention, there is provided parallel and angular cutting means due to the polygonal configuration of the receptacle 66 and the upper cover 68. In this manner, a nail portion can be completely clipped or removed from a nail proper upon a single clipping action of the cutting means 52, 54.

In operation of the device 10, upon actuation of the thumb bar 32 about the second axis, the lower and upper cutting means 52, 54 are moved to a closed clipping position with a portion of a nail interposed between the cutting means to clip or remove the same from a nail. In the cutting position, the upper cover 68 is positioned tightly over the lower receptacle 66 to restrict trajectory of the nail portion removed. In the usual case, the nail clipping will be thrown against walls 70, 78 of the cover and/or receptacle and subsequently drop into the receptacle.

As stated above, the receptacle 66 has an open bottom 74. To cover the open bottom 74 and retain nail clippings in the receptacle, the device is provided with a plate 82 secured to a bottom axial end 84 of the reaction pin 32, off centered with respect thereto and positioned over the open bottom of the receptacle 66 in the operative position of the thumb bar 34. So long as the device 10 is in use, the plate 82 is in a position over the open bottom 74 of the receptacle 66 to retain nail clippings therein.

Emptying the receptacle 66 of clippings is conveniently accomplished by merely rotating the thumb bar 34 from its operative position to its prestored position about the first axis defined by the reaction pin 32. Because the thumb bar 34 is nonrotatably mounted with respect to the reaction pin 32 about the first axis, rotation of the former 180° to its prestored position automatically rotates the latter, the plate 82 mounted eccentrically thereto being moved out of registry with the open bottom 74 of the receptacle. The clippings held by the receptacle 66 are thus permitted to drop from the same into a wastebasket (not shown) or the like. It can thus be seen that the receptacle 66 is automatically emptied upon rotation of the thumb bar 32 to its closed position. In this respect, the device 10 provides an advantage over the prior-art leaf spring type nail clipping device having a receptacle or the like for accumulating clippings. In operation of such prior-art device, an additional step of emptying the receptacle is required subsequent to the setting thumb bar to its inoperative positions. In such device, clippings thus tend to accumulate in the receptacle and thus potentially adversely affect operation of the devices due to failure of a user to take the additional step of emptying the receptacle due to inconvenience in performing such step.

Figure 4:
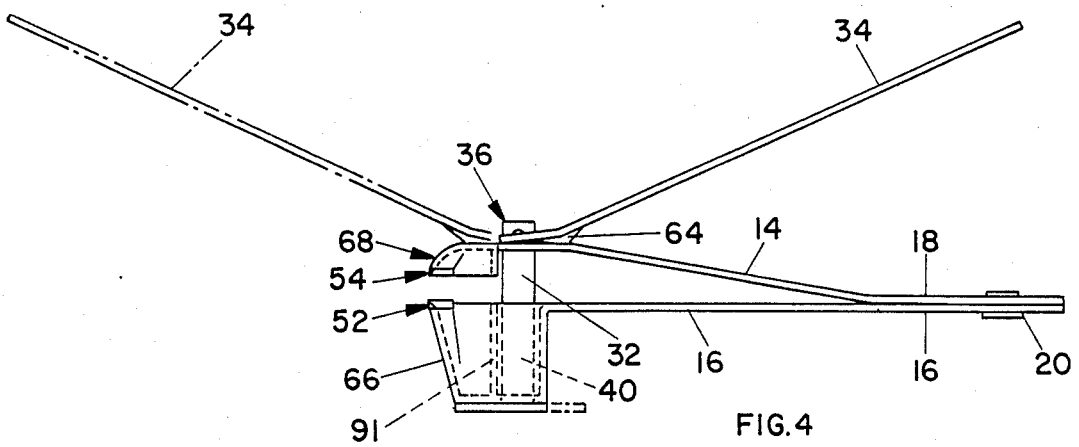
FIG. 4 is a side elevational view of an alternative embodiment of the device.
Figure 5:
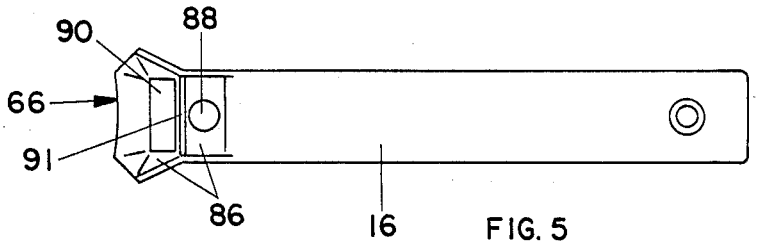
FIG. 5 is a plan view of a lower spring member of the device illustrated in FIG. 4.

An alternative embodiment of the device 10 is illustrated in FIGS. 4 and 5 and is substantially similar to the embodiment shown in FIGS. 1–3, except that in the former embodiment the lower receptacle 66 is provided with a bottom wall 86 having first and second apertures 88, 90. In addition, in the embodiment of FIGS. 4 and 5, the reaction pin 32 does not include the above-described stepped portion 40, but rather is of substantially the same diameter along the full length of the pin. The reaction pin 32 is set in rotatable engagement with the bottom wall 86 of the receptacle 66, with the pin in free registry with the first aperture 88 and positioned within the receptacle behind the second aperture 90 and the plate 82 in constant movable engagement with the bottom wall from a position below the same. The plate 82 provides the reactive force against the spring member 14, as does the shoulder 42 in the embodiment of FIGS. 1–3, during operation of the thumb bar 34. Because of the substantially hidden position of the reaction pin 32 within the receptacle 66, the embodiment of FIGS. 4 and 5 is aesthetically desirable.

As shown in FIG. 4, the plate 82 is of a sufficient size and shape so as to cover the second aperture 90 in the bottom wall 86 of the receptacle 66 in the operative position of the thumb bar 34. However, in the stored position of the thumb bar, the plate 82 is positioned 180° with respect to the aperture 90 and does not cover the same so as to permit emptying of the receptacle 66 of nail clippings in the manner described above. The embodiment of FIGS. 4 and 5 further includes a wall 91 between first and second apertures 88, 90 and for partitioning the reaction pin 32 from that portion of the receptacle 66 receiving clippings so as to prevent the same from interfering with operation of the reaction pin.

A further embodiment of the invention is illustrated in FIGS. 6–9. This embodiment is similar to the embodiments illustrated in FIGS. 1–5 in that the clipping device 92 shown in FIGS. 6–9 includes a receptacle means for preventing the scattering of nail clippings during operation of the device and retaining the clippings for subsequent disposal.

Specifically, the device 92 comprises lower and upper elements 94, 96 of somewhat box-like construction, the lower element having sidewalls 98, front walls 100 and a bottom wall 102, the upper element having sides 104, front sides 106 and a bottom side 108. The front walls 100 and the front sides 106 have their free edges sharpened to form lower and upper cutting means 110, 112 on second ends 114, 116 of the lower and upper elements 94, 96, respectively. The lower and upper elements 94, 96 are hingeably mounted together at respective first ends 118, 120 thereof by a central hinge part 122 formed on and extending outwardly from the lower element first end, a pair of identical side hinge parts 124 formed on and extending outwardly from the upper element first end and aligned with the central hinge part, and a hinge pin 126 received in the aligned central and side hinge parts. In this manner, the lower and upper elements 94, 96 are movable between an open position illustrated in FIG. 9 where the elements are positioned relatively far apart, a preclipping position shown in FIG. 7 where the elements are positioned in relatively close spaced-apart relationship, and a closed clipping position shown in FIG. 8 where the lower and upper clipping means 110, 112 are set in clamping engagement. In the preclipping and clipping positions, the side, front and bottom walls 98, 100, 102 of the lower element 94 provide a receptacle for nail clippings sheared from nails by the lower and upper clipping means 110, 112 during operation of the device 92. The lower and upper elements of 94, 96 are preferably made of stainless or plated steel.

To actuate movement of the lower and upper elements 94, 96 to the closed clipping position from the preclipping position and to mount the second ends 114, 116 of the elements together in their preclipping and clipping positions, the device 92 is provided with a semicircular retainer 128, a reaction pin 130, a spring 132 and a thumb bar 134.

The semicircular retainer 128 is securely mounted to the bottom wall 102 of the lower element 94 at the second side 114 thereof, and to this end, the a deepened lower element has at the second end thereof portion 136 in which the retainer is positioned. The semicircular retainer 134 has back, outside and top walls 138, 140, 142 and open front and inside areas 144, 146. The bottom wall 102 of the lower element forms a bottom wall of the retainer Because the retainer is semicircular in shape, the same defines a central socket 148. A semicircular channel 150 is formed by the interior of the retainer 128, the open front and inside areas 144, 146 providing access to the channel. The top wall 142 of the retainer 128 has formed therein a pair of first dimples 152 positioned relatively close to the open front 144 of the retainer 128 and intruding upon the channel 150, and a second dimple 154 positioned opposite the first dimples with respect to the central socket 148 and closely adjacent the back wall 138 and also intruding upon the channel 150. The retainer 128 is preferably constructed of stainless or plated steel.

As indicated above, the lower and upper elements 94, 96 are mounted together at second ends 114, 116 thereof in preclipping and closed positions. The reaction pin 130 and the thumb bar 134 provide such mounting, and, to this end, the reaction pin comprises a latch pin 156 rigidly secured and extending laterally with respect to the reaction pin at a bottom portion 158 thereof and adjacent to the bottom axial end 160 of the same, a central horizontal collar 162 extending around the full circumference of the pin above the latch, and a downwardly-facing notch 164 formed in a sidewall 166 of the pin opposite the latch pin and above the collar. The notch 164 is substantially identical to the notch 38 in the retainer pin 32 heretofore described with respect to the embodiments of the FIGS. 1–5. In the preclipping and clipping positions of the elements 94, 96, the reaction pin 130 is set in registry with the central socket 148 of the retainer 128, with the latch pin 156 in registry with the channel 150. In such positions of the lower and upper elements 94, 96, with the latch pin 156 in registry with the channel 150, the top wall 142 of the retainer 128 prevents vertical movement of the latch pin to prevent detachment of the reaction pin from the lower element. When the reaction pin 130 is rotated to set the latch pin 156 out of registry with the channel 150, the top wall 142 of the retainer no longer prevents detachment of the reaction pin from the lower element 94, thus permitting the elements to move to their open position.

In all positions of the lower and upper elements 94, 96, the spring 132 circumscribes the pin 130 and rests on the collar 162 of the same. In addition, an upper portion 168 of the reaction pin 130 is set in constant, free, rotatable registry with a hole 170 in the second end 116 of the upper element and aligned with the central socket 148, the spring 130 positioned between the collar 162 and the bottom side 108 of the upper element 96.

The thumb bar 134 includes a notch 172 formed in a transverse end 174 of the bar, thereby forming bifurcated portions 176 between which spans a crossbar 178. The notch 172 is aligned with the aligned hole 170 and central socket 148. The thumb bar 132 is positioned above the upper element 96 and mounted to the reaction pin 130 for nonrotatable movement with respect thereto about a first axis defined by the reaction pin, with the bifurcated portions 176 straddling the pin upper portion 168 and the crossbar 178 securely engaging the pin within the notch 164 of the same. In this position of the thumb bar 134, the same compresses the spring 132 which reacts to force the crossbar 178 of the thumb bar in secure engagement with the reaction pin 130 and within the notch 164 thereby maintaining a secure mounting of the upper element 96 in sandwiched relationship between the thumb bar and the reaction pin.

Figure 6:
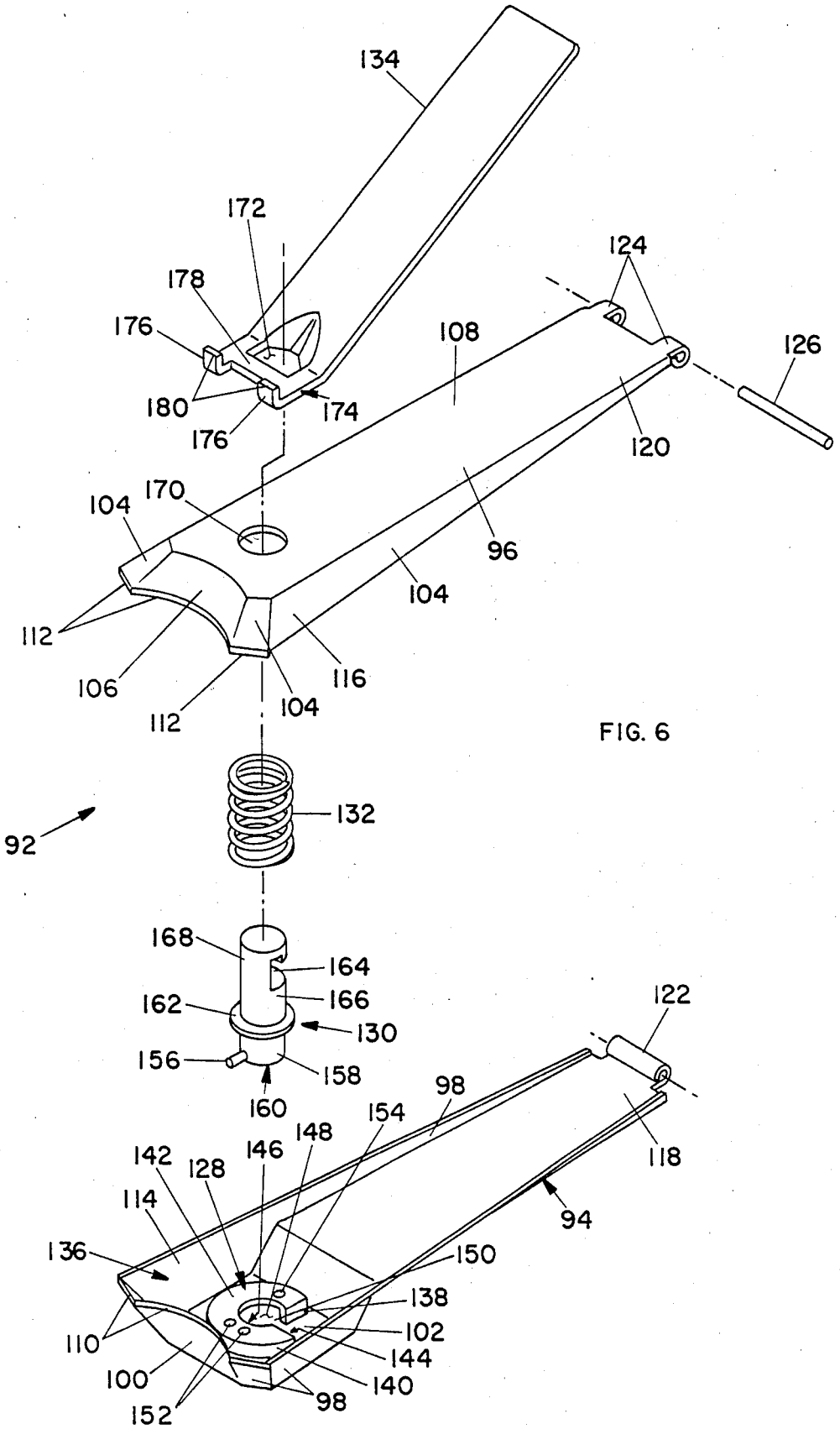
FIG. 6 is an exploded perspective view of a further embodiment of the device.
Figure 7:
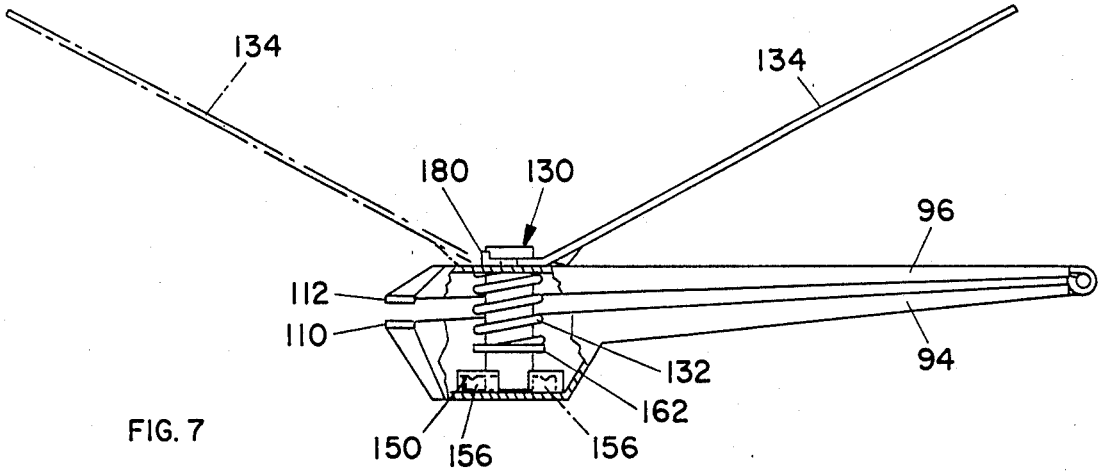
FIG. 7 is a side elevational view of the device illustrated in FIG. 6 and showing lower and upper elements thereof in a preclosed position.
Figure 8:
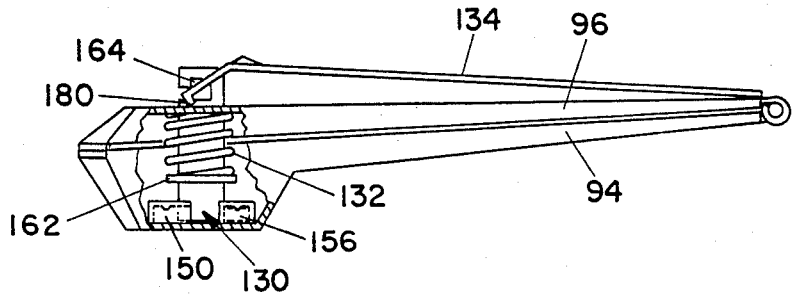
FIG. 8 is a side elevational view of the device shown in FIGS. 6 and 7 illustrating the lower and upper elements in a closed position.

The thumb bar, 134 along with the reaction pin 132, is rotatable about the first axis 360° with respect to the lower and upper elements 94, 96 between an operative position shown in FIGS. 6 and 7 in solid lines and a prestored position illustrated in FIG. 7 in phantom lines. The thumb bar 134 also rotatable with respect to the reaction pin about a second axis normal to the first axis and defined by the cross bar to a stored position in overlapping engagement with the upper element 96 as shown in FIG. 8 in phantom lines. The thumb bar 134 can be moved from the operative position to the stored position, by turning the thumb bar about the first axis from the operative position to the prestored position of the thumb bar, and subsequently rotating the thumb bar about the second axis in overlapping engagement with the upper element 96 as described above with respect to the embodiments illustrated in FIGS. 1–5.

Figure 9:
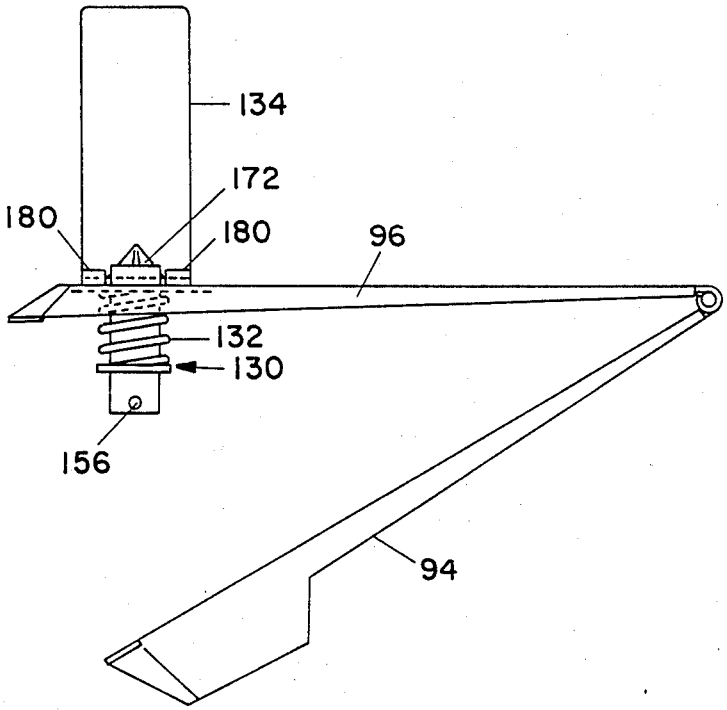
FIG. 9 is a side elevational view of the device shown in FIGS. 6–8 illustrating the lower and upper elements in an open position.

It is important to note that in the position of the thumb bar illustrated in FIG. 9, with the thumb bar moved 90° from either its operative or prestored positions, the latch pin 156 is positioned out of registry with the channel 150 of the retainer 128 and out of the engagement with the top wall 142 of the same thereby permitting free hingeable movement of the lower and upper elements 94, 96 to their open position. In the operative position of the thumb bar 134, shown in FIGS. 6 and 7, the latch pin 156 is positioned in registry with the channel 150, between the first dimples 152 and against the top wall 142 of the retainer 128 to thereby retain the lower and upper elements in their preclipping position. The first dimples prevent inadvertent movement of the latch pin 156 and thus the thumb bar 134 about the first axis from its operative position. In this manner, the first dimples function like the indexing means 56, 58 heretofore described with respect to the embodiments of FIGS. 1–5 and for preventing inadvertent rotational movement of the thumb bar 34 with respect to the lower and upper spring members 12, 14 in the operative and stored positions. In the prestored position of the thumb bar 134, the latch pin 156 is positioned within the channel 150 of the semicircular retainer 128 between the back wall 138 thereof and the second dimple 154 to thereby retain the lower and upper elements 94, 96 in their preclipping position. Like the first dimples 152, the second dimple 154 in cooperation with the back wall 138 of the retainer 128 prevents inadvertent movement of the latch pin 156 and thus the thumb bar about the first axis in the prestored position as well as in the stored position of the same.

In the stored position of the thumb bar 134, the same exerts a downward force on the upper element 96 against the biasing force of the spring 132 to set the lower and upper elements 94, 96 in their clipping position to thereby prevent nail clippings between the elements from falling through the gap or space that would otherwise exist between the elements in the preclipping position of the same. To this end, ends 186 of the bifurcated portions 176 of the thumb bar are bent at 90° with respect thereto so as to bear down upon the upper element 96 in the stored position of the thumb bar 134.

The second ends 114, 116 of the lower and upper elements 94, 96 are flexed to move to their clipping position, with the lower and upper clipping means 110, 112 in tight engagement, in the operative position of the thumb bar 134 by applying a downward force thereto. To this end, the thumb bar 34 is provided with a heel 182 adjacent the notch 172, engaging the upper element 94 in the operative position of the thumb bar, and reactive against the downwardly-facing notch 164 of the reaction pin 130, upon downward movement of the thumb bar with respect to the lower and upper elements, to move the same together to effect clipping of a nail interposed between the lower and upper clipping means 110, 112.

When it is desired to clip fingernails or toenails, the thumb bar 134 is first moved about the second axis from its stored position shown in FIG. 8 to its prestored position shown in FIG. 7 in phantom lines thereby moving the elements 94, 96 from their closed clipping position to the preclipping position. The thumb bar 134 is then rotated 180° about the first axis to its operative position thereby also rotating the reaction pin 130 and setting the latch pin 156 between the first dimples 152. Subsequently, the thumb bar 134 is rotated downwardly about the second axis to set the lower and upper elements 94, 96 in their clipping position to thereby cause the lower and upper clipping means 110, 112 to bear down upon a nail positioned between the clipping means and sever from the nail a portion thereof, the clipping being prevented from scattering from the device 92 and retained between the lower and upper elements. When the user has completed the manicure or pedicure, clippings can thereafter be removed from between the lower and upper elements 94, 96. To remove the clippings, the thumb bar 134 is rotated about the first axis to the position shown in FIG. 9, thereby setting the latch pin 156 out of registry with the retainer 128 to permit pivoting of the lower element with respect to the upper element 96 to set the elements in their open position. Thereafter, the device is inverted to empty the clippings from the lower element. The lower element 94 is then pivoted toward the upper element 96 to set the pin 130 in registry with the socket 148 of the retainer 128 and the thumb bar 134 is rotated to its stored position and then prestored position. If, on the other hand, it is desired to store clippings, due to the inability at any particular time to have opportunity to dispose of the same, the thumb bar 134 is moved from its operative to its stored position, in which case the bent ends 180 of the thumb bar bear down on the upper element 96 to set the elements 94, 96 in their closed position so as to prevent escape of the clippings from between the elements. The clippings thus stored can sometime thereafter be disposed of by setting the thumb bar 134 in the position illustrated in FIG. 9 as heretofore described.

It should be noted that the lower element front walls 100 are set at angles with respect to one another and the upper element front sides 106 are also set at angles to one another. By this design, the device 92 is provided with clipping means 110, 112 for removing a nail portion from a nail proper upon a single actuation of the thumb bar 134.

It should also be noted that, unlike the embodiments illustrated in FIGS. 1–5, in the embodiment illustrated in FIGS. 6–9, clippings are not automatically disposed of upon rotation of the thumb bar 134 from its operative position to its prestored position because, as stated above, in the prestored position, as well as the stored position, of the thumb bar, the latch pin 156 is held by the retainer thereby preventing opening of the lower and upper elements However, this embodiment has an advantage over the embodiments of FIGS. 1–5 in that it permits storage of the clippings when the thumb bar is in the stored position. In the embodiments shown in FIGS. 1–5, movement of the thumb bar 34 to its prestored position automatically empties the receptacle of the clippings.

While the invention has been described in connection with a preferred embodiment, it will be understood that the invention is not limited to the disclosed embodiment To the contrary, reasonable variations, alternatives, modifications and equivalents are possible within the spirit and scope of the invention as defined by the appended claims.

I claim:

1. In a nail clipping device comprising a pair of lower and upper spring members joined at respective first ends thereof and resiliently diverging at respective second ends, opposed lower and upper cutting means on said lower and upper spring member second ends, respectively, a reaction pin rotatably carried by said second ends and having shoulder means abutting said lower spring member and a notch positioned above said upper spring member, a thumb bar having an end received in said notch to secure said thumb bar to said reaction pin, rotatable with said reaction pin and a first axis coinciding with the longitudinal axis of said reaction pin to an operative position aligned with said lower and upper spring members, rotatable relative to said reaction pin about a second axis normal to said first axis and having a fulcrum positioned to engage said upper spring member when said thumb bar is rotated about said second axis in said operative position to urge said cutting means together in nail clipping engagement, said lower spring member further comprising a receptacle means fixed thereto and positioned to receive nail clippings, the improvement wherein:

said receptacle means comprises an outlet;

and said device further comprises closure means positioned to close said outlet in said operative position of said thumb bar and adapted to automatically move from said closed position to permit clippings to be removed from said receptacle means through said outlet upon rotation of said thumb bar from said operative position about said first axis.

2. A device according to claim 1, wherein said closure means is carried by said reaction pin and adapted to be moved to and from said closed position when said thumb bar is moved to and from said operative position about said first axis.

3. A device according to claim 2, wherein said receptacle means comprises a bottom defining said outlet; and said closure means comprises a plate cooperable with said receptacle means over said outlet to retain clippings within said receptacle means in said operative position of said thumb bar.

4. A device according to claim 3, wherein said receptacle means further comprises an open top; and said device further comprises a cover on said upper spring member second end and adapted to register with said receptacle means open top to prevent scattering of clippings and deflect same into said receptacle means when said thumb bar is rotated about said second axis and said lower and upper cutting means are urged together in nail clipping engagement.

5. A device according to claim 4, wherein said receptacle means further comprises back, side and front walls and said cover comprises back, front and sides, said receptacle means front wall adapted to be set in aligned engagement with said cover front when said thumb bar is rotated about said second axis; and said lower cutting means being formed by a sharpened free edge of said receptacle means front wall, and said upper cutting means being formed by a sharpened free end of said cover front, said upper and lower cutting means being adapted to move together in aligned nail clipping engagement when said thumb bar is rotated about said second axis.

6. A device according to claim 5, wherein said receptacle means sidewalls are adapted to be set in aligned engagement with said cover sides when said thumb bar is rotated about said second axis; and said lower cutting means being further formed by sharpened free edges of said receptacle means sidewalls, and said upper cutting means being further formed by sharpened free ends of said cover sides, said lower and upper cutting means cooperable to clip a nail portion from a nail upon a single rotation of said thumb bar about said second axis.

7. A device according to claim 6, wherein said receptacle means sidewalls and said cover sides are positioned at obtuse angles with respect to said receptacle means front wall and said cover front, respectively.

8. A device according to claim 7, wherein said reaction pin further comprises a stepped portion positioned below said lower spring member; and said shoulder means comprises an upper edge of said stepped portion and against which said lower spring member rotatably abuts.

9. A device according to claim 8, wherein said device further comprises an indexing means for preventing inadvertent rotational movement of said thumb bar with respect to said lower and upper spring members in said operative position of said thumb bar.

10. A device according to claim 9, wherein said indexing means comprises at least one flange on said reaction pin and at least one notch on one of said upper and lower spring members, said flange adapted to be received in said notch in said operative position of said thumb bar.

11. A device according to claim 10, wherein said flange is formed on said upper edge of said reaction pin stepped portion and said notch is formed in said lower spring member.

12. A device according to claim 5, wherein said receptacle means comprises a bottom wall having an opening extending therethrough;

said reaction pin is positioned in rotatable registry with said opening and within said receptacle means; and said closure plate is carried by said pin below said receptacle means bottom wall and defines said shoulder means in constant engagement with said bottom wall when said plate is moved to and from said closed position.

13. A device according to claim 12, wherein receptacle means comprises an inner wall positioned between said outlet and said opening and for preventing clippings retained by said receptacle means from interfering with operation of said reaction pin.

14. A device according to claim 1, wherein said receptacle means comprises an open top; and said device further comprises a cover on said upper spring member second end and adapted to register with said open top to prevent scattering of clippings and deflect same into said receptacle means when said thumb bar is rotated about said second axis and said cutting means are urged together in nail clipping engagement.

15. A device according to claim 14, wherein said receptacle means further comprises back, side and front walls and said cover means comprises a back, a front and sides, said receptacle means front wall adapted to be set in aligned engagement with said cover front when said thumb bar is rotated about said second axis; and said lower cutting means being formed by a sharpened free edge of said receptacle means front wall, and said upper cutting means being formed by a sharpened free end of said cover front, said lower and upper cutting means being adapted to move together in aligned nail clipping engagement when said thumb bar is rotated about said second axis.

16. A device according to claim 15, wherein said receptacle means sidewalls are adapted to be set in aligned engagement with said cover sides when said thumb bar is rotated about said second axis; and said lower cutting means being further formed by sharpened free edges of said receptacle means sidewalls, and said upper cutting means being further formed by sharpened free ends of said cover sides, said lower and upper cutting means cooperable to clip a nail portion from a nail upon a single rotation of said thumb bar about said second axis.

17. A device according to claim 1, wherein said reaction pin further comprises a stepped portion positioned below said lower spring member; and said shoulder means comprises an upper edge of said stepped portion and against which said lower spring member rotatably abuts.

18. A device according to claim 17, wherein said device further comprises an indexing means for preventing inadvertent rotational movement of said thumb bar with respect to said lower and upper spring members in said operative position of said thumb bar.

19. A device according to claim 18, wherein said indexing means comprises at least one flange on said reaction pin and at least one notch in one of said upper and lower spring members, said flange adapted to be received in said notch in said operative position of said thumb bar.

20. A device according to claim 19, wherein said flange is formed on said upper edge of said reaction pin stepped portion and said notch is formed in said lower spring member.

21. In a nail clipping device comprising:

a pair of lower and upper elements positioned in overlapping relationship, having respective first and second ends, hingeably mounted together at said respective first ends and movable between an open position spaced relatively far apart, a preclosed position spaced relatively close together and a closed position;

lower and upper cutting means on said lower and upper element respective second ends and adapted to cooperate to clip a nail interposed between said lower and upper cutting means in said closed position of said lower and upper elements;

a reaction pin rotatably carried by said upper element second end and having a notch positioned above said upper element;

biasing means positioned between said lower and upper elements and biasing said elements from said closed position;

a thumb bar having an end received in said notch to mount said thumb bar to said reaction pin, rotatable with said reaction pin about a first axis coinciding with a longitudinal axis of said reaction pin between an operative position in substantially overlapping relationship to said lower and upper elements and a second position, rotatable relative to said reaction pin about a second axis normal to said first axis and having a fulcrum positioned to engage said upper element when said thumb bar is rotated about said second axis in said operative position against said biasing means to set said lower and upper cutting means in nail clipping engagement;

latch means adapted to engage said lower element in said operative position of said thumb bar to set said lower and upper elements in said preclosed position and adapted to automatically move out of engagement with said lower element upon rotation of said thumb bar to said second position to dispose said lower and upper elements in said open position; and receptacle means on said lower element and adapted to receive nail clippings and to be emptied of the same in said open position of said lower and upper elements.

22. A device according to claim 21, wherein said device further comprises a retainer means on said lower element; and said latch means is carried by said reaction pin and adapted to be moved to and from engagement with said retainer means to set said lower and upper elements to said preclosed and open positions when said thumb bar is moved to said operative and second positions, respectively.

23. A device according to claim 22, wherein said device further comprises an indexing means on said retainer means and for restricting movement of said latch means and preventing inadvertent rotational movement of said thumb bar with respect to said lower and upper elements in said operative position of said thumb bar.

24. A device according to claim 22, wherein said retainer means comprises a first wall defining a channel below the same; and said latch means comprises a latch pin carried by said reaction pin and adapted to be moved to and from engagement with said top wall and in registry with said channel to set said lower and upper elements to said closed and open positions when said thumb bar is moved to said operative and second positions, respectively.

25. A device according to claim 24, wherein said device further comprises an indexing means on said retainer means and for restricting movement of said latch pin and preventing inadvertent rotational movement of said thumb bar with respect to said lower and upper elements in said operative position of said thumb bar.

26. A device according to claim 25, wherein said indexing means comprises a pair of first dimples in said retainer means first wall and intruding within said channel, said latch pin adapted to engage said first wall between said dimples in said second and operative positions of said thumb bar in said operative position of said thumb bar.

27. A device according to claim 22, wherein said lower element comprises bottom, side and front walls, said walls defining said receptacle means and said receptacle means having an open top; and said upper element comprises a top, a front and sides, said top, front and sides defining a cover adapted to align with said receptacle means open top to prevent scattering of clippings and deflect same into said receptacle means when said thumb bar is rotated about said second axis and said cutting means are urged together in nail clipping engagement.

28. A device according to claim 27, wherein said receptacle means front wall is adapted to be set in aligned engagement with said cover front when said thumb bar is rotated about said second axis; and said lower cutting means is formed by a sharpened free edge of said receptacle means front wall and said upper cutting means is formed by a sharpened free end of said cover front, said lower and upper cutting means adapted to move together in aligned nail clipping engagement when said thumb bar is rotated about said second axis.

29. A device according to claim 28, wherein said receptacle means sidewalls are adapted to be set in aligned engagement with said cover sides when said thumb bar is rotated about said second axis; and said lower cutting means is further formed by sharpened free edges of said receptacle means sidewalls, and said upper cutting means is further formed by sharpened free ends of said cover sides, said lower and upper cutting means cooperating to clip a nail portion from a nail upon a single rotation of said thumb bar about said second axis.

30. A device according to claim 29, wherein said receptacle means sidewalls and said cover sides are positioned at obtuse angles with respect to said receptacle means front wall and said cover front wall, respectively.

31. A device according to claim 22, wherein said reaction pin further comprises a capture means positioned below said notch; and said biasing means is held by said capture means and biased between said capture means and said upper element.

32. A device according to claim 21, wherein said thumb bar is rotatable about said first axis to a third position removed from said first position, is rotatable about said second axis from said third position to a stored position in overlapping relationship to said lower and upper elements and further comprises a means engaging said upper element and for urging said lower and upper elements to said closed position in said stored position of said thumb bar.

33. A device according to claim 32 , wherein said urging means is formed by a bent part of said end of said thumb bar.

34. A device according to claim 23, wherein said thumb bar is rotatable about said first axis to a third position removed from said first position, said latch means engaging said retainer means in said third position of said thumb bar, and is rotatable about said second axis from said third position to a stored position in overlapping relationship to said lower and upper elements; and said indexing means further restricts movement of said latch means and inadvertent rotational movement of said thumb bar with respect to said upper and lower elements in said third and stored positions of said thumb bar.

35. A device according to claim 34, wherein said thumb bar further comprises a means engaging said upper element and for urging said lower and upper elements to said closed position in said stored position of said thumb bar.

36. A device according to claim 35, wherein said thumb bar urging means is formed by a bent part of said end of said thumb bar.

37. A device according to claim 26, wherein said thumb bar is rotatable about said first axis to a third position removed from said first position, said latch pin engaging said retainer means first wall within said channel in said third position, and is rotatable about said second axis from said third position to a stored position in overlapping relationship to said lower and upper elements; and said indexing means further restricts movement of said latch means and prevents inadvertent rotational movement of said thumb bar with respect to said lower and upper elements in said third and stored positions of said thumb bar.

38. A device according to claim 37, wherein said indexing means further comprises a second wall of said retainer means and a second dimple formed in said retainer means first wall, intruding within said channel, said latch pin adapted to engage said first wall between said second wall and said second dimple in said third and stored positions of said thumb bar.

39. A device according to claim 38, wherein said thumb bar further comprises a means engaging said upper element and for urging said lower and upper elements to said closed position in said stored position of said thumb bar.

40. A device according to claim 39, wherein said thumb bar urging means is formed by a bent part of said end of said thumb bar.

* * * * *